US005142752A

United States Patent [19]

Greenway et al.

[11] Patent Number: 5,142,752

[45] Date of Patent: Sep. 1, 1992

[54] METHOD FOR PRODUCING TEXTURED NONWOVEN FABRIC

[75] Inventors: John M. Greenway, Westwood; Russell H. Hughes, Wrentham, both of Mass.

[73] Assignee: International Paper Company, Purchase, N.Y.

[21] Appl. No.: 494,705

[22] Filed: Mar. 16, 1990

[51] Int. Cl.[5] ..... D04H 1/46

[52] U.S. Cl. ..... 28/105; 28/104; 428/299

[58] Field of Search ..... 28/104, 105; 428/299

[56] References Cited

U.S. PATENT DOCUMENTS 4,555,430 11/1985 Mays ..... 428/299
4,925,722 5/1990 Jeffers et al. ..... 428/299
4,959,894 10/1990 Jeffers et al. ..... 28/104
4,960,630 10/1990 Greenway et al. ..... 28/104

*Primary Examiner*—James J. Bell
*Attorney, Agent, or Firm*—Walt Thomas Zielinski

[57] ABSTRACT

An apparatus and related process for entangling a fibrous web which employs columnar fluid jets to eject a continuous curtain of fluid in an entangling station. The web is advanced through an entangling station on a conveyor which supports an entangling member having a symmetrical pattern of void areas. Baffle members disposed in the void areas are provided which include radiused curvatures and define apertures having a frusto-conical configuration. Dynamic forces in the fluid curtain impact the web in discrete and controlled patterns determined by the baffling members to enhance efficient energy transfer and web entanglement. Textile-like fabrics having a uniform, non-apertured, surface cover are obtained by coaction of fluid curtain and baffle structures.

10 Claims, 15 Drawing Sheets

METHOD FOR PRODUCING TEXTURED NONWOVEN FABRIC

FIELD OF INVENTION

This invention generally relates to nonwoven fabrics having industrial, hospital and household applications, and more particularly, fluid entangled nonwoven fabrics and substrates which have symmetrical structures. Nonwoven fabrics produced by the method of the invention have a patterned textile-like aesthetic finish.

BACKGROUND ART

Nonwoven fabrics are conventionally manufactured from webs of staple fibers which are provided, through various bonding techniques, with structural integrity and desired fabric characteristics. Fluid entangling techniques in which nonwoven webs are mechanically bonded by application of dynamic fluid forces to web materials are among the most widely utilized processes for manufacturing nonwoven fabrics.

Conventional nonwoven process lines employ carding apparatus to process staple fibers for use in nonwoven fabrics. In the carding process staple fibers are opened, aligned, and formed into a continuous web free of impurities. An exemplary carding apparatus is illustrated in U.S. Pat. No. 3,768,118 to Ruffo et al.

Following carding operations, the processed fiber webs are treated with high pressure columnar fluid jets while supported on apertured patterning screens. Typically, the patterning screen is provided on a drum or continuous planar conveyor which traverses pressurized fluid jets to entangle the web into cohesive ordered fiber groups and configurations corresponding to void areas in the patterning screen. Entanglement is effected by action of the fluid jets which cause fibers in the web to migrate to void areas in the screen, entangle and intertwine.

Prior art hydroentangling processes for producing patterned nonwoven fabrics which employ high pressure columnar jet streams are represented by U.S. Pat. Nos. 3,485,706 and 3,498,874, respectively, to Evans and Evans et al., U.S. Pat. No. 3,485,708 to J. W. Ballou et al., and U.S. Pat. No. 2,862,251 to F. Kalwaites.

The art has recognized that fiber orientation within nonwoven web materials employed in fluid entangling processes correlates to physical properties in the bonded and processed nonwoven fabrics. Fibers in carded webs are characterized by machine direction ("MD") and cross-direction ("CD") web axes. MD and CD fiber orientations respectively refer to orientation in the process and cross directions on nonwoven process lines. Carded webs have a predominance of MD fibers which yield fabrics having correspondingly enhanced MD and diminished CD tensile strength.

To provide uniform tensile strength characteristics in nonwoven fabrics, the art has introduced techniques which randomize web fibers prior to bonding. For example, it is known in the art to employ airlay systems to randomize carded web materials. Such systems typically include disperser mechanisms which disperse fibers from a mat composed of fibers into a turbulent air stream for randomization and collection on web forming screens. Exemplary airlay systems are shown in U.S. Pat. No. 3,900,921 to Zafiroglu and U.S. Pat. No. 4,089,086 to Contractor et al.

Another technique employed in the art to "randomize" web fibers includes the use of "randomizing rollers" and doffing mechanisms in carding operations.

From the foregoing, it will be appreciated that prior art techniques for enhancement of tensile strength in nonwoven materials have been directed to pre-entanglement web processing. The present invention is directed to a fluid entangling process and related apparatus which obtains a higher degree of fiber entanglement with consequent improved fabric texture and tensile characteristics. An entangling support member is provided for use in a conventional process line which generates patterned concentrations of energy flux to enhance fiber entanglement. Advantageously, the apparatus of the invention can be integrated with conventional nonwoven production lines without requirement of extensive and costly retooling.

It is a broad object of the invention to provide an improved nonwoven fabric having textile-like aesthetics and tensile strength features which advance the art.

A more specific object of the invention is to provide an improved hydroentangling process which yields a durable, nonwoven fabric which is characterized by conformability to wiping surfaces, supple drape, dimensional stability, and textile-like qualities.

A still further object of the invention is to provide an apparatus and process for production of nonwoven fabrics which obtain improved production line efficiencies and process speeds.

DISCLOSURE OF THE INVENTION

In the present invention, these purposes, as well as others which will be apparent, are achieved generally by providing an apparatus and related process for entangling a staple fibrous web which employs an entangling member for supporting the web including a symmetrical pattern of fluid pervious void areas, conveyor means for advancing the entangling member through an entangling station, and curtain means disposed above the conveyor means for directing a continuous curtain of fluid downwardly through the nonwoven web. Control means are provided for focusing fluid energy associated with the curtain means into discrete concentrated patterns corresponding to the symmetrical void areas. The fluid curtain coacts with the entangling member and control means to precisely orient the web fiber structure and entangle web fibers into a coherent lattice structure.

In a preferred embodiment the entangling member is formed from a plate including a plurality of generally circular apertures which each have a circumferential edge, and the control means comprises baffle members which are integral with and depend downwardly from the circumferential aperture edges. Preferred entangling results are obtained by provision of baffle members including a radiused curvature which define apertures having a "frusto-conical" configuration.

In accordance with another aspect of the invention, the apparatus further comprises a pre-entanglement member and associated fluid curtain. The pre-entanglement member, which is preferably a woven screen, is employed to effect entanglement of one side of the web. Thereafter, the web is advanced to the frusto-conical entangling member for entanglement of the other side of the web. This two stage entanglement process enhances interstitial binding of web fibers in the entangled web fabric.

It is a feature of the invention to employ an entangling member which has a symmetrical pattern of void areas which correspond to preferred fabric patterns. The void areas preferably occupy at least 15 per cent of the entangling member area. The preferred pattern includes a plurality of frusto-conical apertures arranged so that the spacing ratio of machine direction ("MD") apertures is greater than cross direction ("CD") apertures. This pattern yields a novel textile-like fabric pattern in which an array of dense nodes are connected by a diamond shaped pattern of interstitial fibers.

Preferred fabrics of the invention are fabricated of webs of staple fibers having basis weights in the range of 20–120 gsy. Aesthetic textile fabric finishes are obtained in accordance with the invention employing fluid pervious support members, in a two stage entangling process at energies in the range of 0.2–1.0 hp-hr/lb. Use of the control means of the invention in conjunction with the patterning member yields energy transfer and processing efficiencies in the production of nonwoven fabrics. Improved energy transfer to the web enhances fiber entanglement and fabric tensile strength characteristics.

Other objects, features and advantages of the present invention will be apparent when the detailed description of the preferred embodiments of the invention are considered in conjunction with the drawings which should be construed in an illustrative and not limiting sense as follows:

BEST MODE OF CARRYING OUT THE INVENTION

Figure 1:
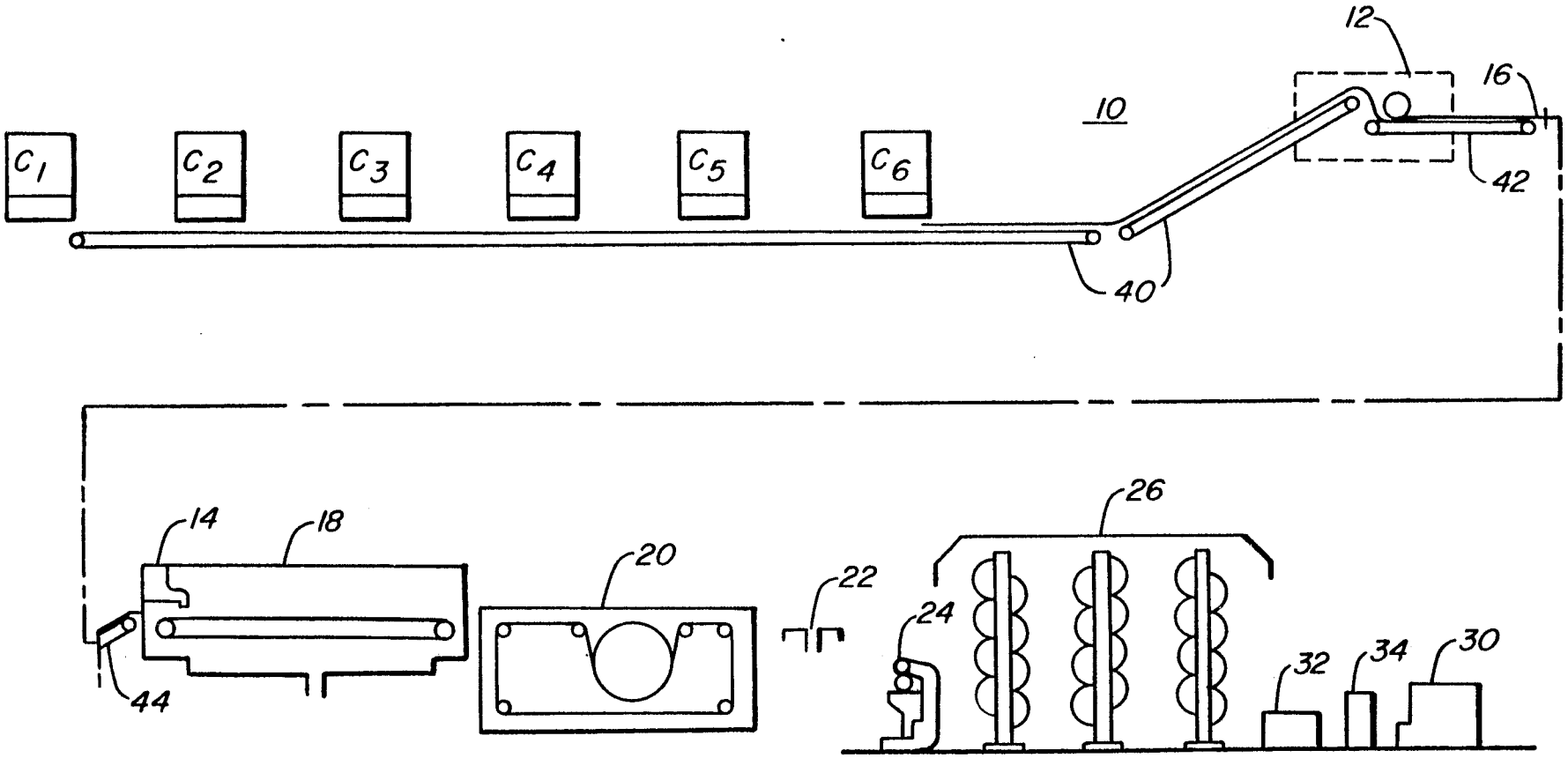
FIG. 1 is a schematic view of a production line including high speed cards, a random web former, planar and cylindrical hydroentangling modules, a padder, dry cans, and other apparatus for the production of nonwoven fabrics in accordance with the invention.

With reference to the drawings, FIG. 1 shows a fabric process line 10 in accordance with the invention for production of nonwoven fabrics including, a series of conventional carding apparatus C1–C6, a random web former 12, conveyor belts 40, 42 and 44, and pre-wet wire station 14 which feeds a randomized web 16 to hydroentangling modules 18, 20. At the output end of the entangling module 20, the line includes a vacuum slot extractor station 22, a conventional padder 24, and dry cans 26 which provide a finished nonwoven fabric 16 for stock rolling on a winder 30. An antistatic roll 32 and weight determination gauge 34 are also employed on the line.

Figure 1A:
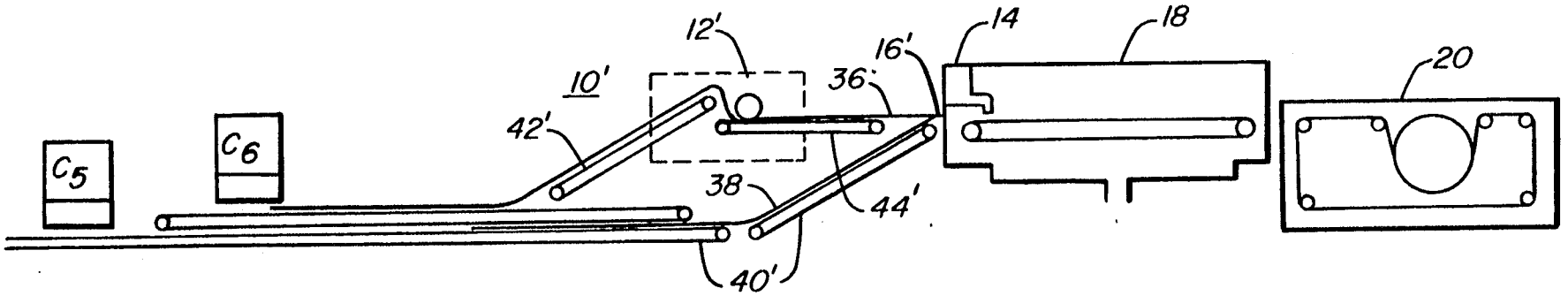
FIG. 1A is a partial schematic view of an alternative production line, similar to FIG. 1, which employs an air lay web former, in conjunction high speed cards to provide a composite air laid/carded web for processing in accordance with the invention.

FIG. 1A shows an alternative production line 10′ which employs an air lay web former 12′, and conveyor belts 40′, 42′ and 44′, in conjunction with the high speed cards C1–C6 to provide a composite air laid/carded web 16′ for processing in accordance with the invention. In other respects the FIG. 1A line is the same as the FIG. 1 line and accordingly like reference numerals are used to designate corresponding elements.

Composite web 16′ includes upper and lower layers 36, 38 which are carded and advanced on conveyors 40′, 42′ and 44′ for combination and feeding to entanglement module 18. Upper layer 36 is processed in the air lay web former 12′ to provide a 50/50 carded-air laid composite web 16′.

Modules 18, 20 effect two sided entanglement of the web 16, 16′ to provide a fabric with well defined interstitial fiber entanglement and structure. As described hereinafter, advantage is obtained in the invention through use of a novel control means to obtain enhanced energy and processing efficiencies in entanglement modules 18, 20.

METHOD AND MECHANISM OF THE ENTANGLING MODULES

Figure 3:
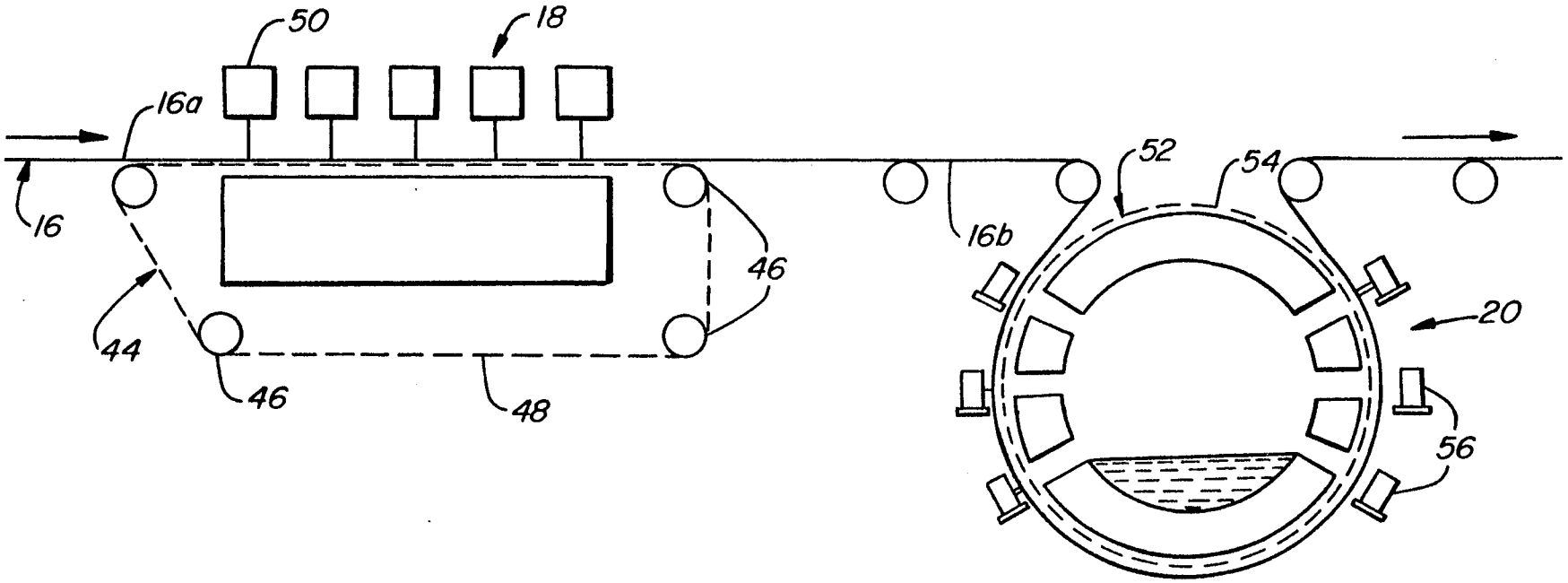
FIG. 3 is a schematic sectional view of the planar and drum hydroentanglement modules illustrated in the production line of FIG. 1.

FIG. 3 illustrates the entanglement modules 18, 20 which are utilized in a two staged process to hydroentangle, in succession, top and bottom sides 16*a*, 16*b*, of the web.

Module 18 includes a first entangling member 44 supported on an endless conveyor means which includes rollers 46 and drive means (not shown) for rotation of the rollers. Preferred line speeds for the conveyor are in the range of 50 to 600 ft/min.

Figure 4A:
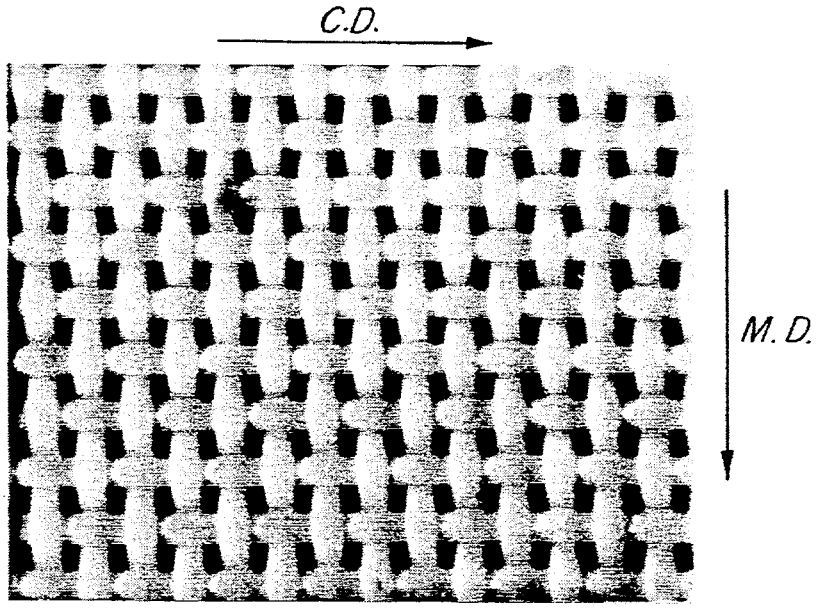
FIG. 4A is a photograph at 4.5× magnification of a 36×29 mesh plain weave forming member employed in the flat entangling module of FIG. 3.

The entangling member 44, which preferably has a planar configuration, includes a symmetrical pattern of void areas 48 which are fluid pervious. A preferred entangling member 44, shown in FIG. 4A, is a 36×29 mesh weave having a 24% void area, fabricated of polyester warp and shute round wire. Entangling member 44 is a tight seamless weave which is not subject to angular displacement or snag. Specifications for the screen, which is manufactured by Appleton Wire Incorporated, P.0. Box 508, Kirby, Portland, Tenn. 37148, are set forth in Table I.

Module 18 also includes means for impacting the web with a uniform curtain of fluid which coacts with the entangling member. The curtain means includes an arrangement of parallel spaced manifolds 50 oriented in a cross-direction ("CD") relative to movement of the composite web 16. The manifolds, which are spaced approximately 10 inches apart and positioned approximately ½ inch above the first entangling member 44, each include a plurality of closely aligned and spaced jet orifices (not shown) designed to impact the web with a continuous "curtain" of fluid at pressures in the range of 300 to 2000 psi. Manifold pressures are preferably ramped in the machine direction so that increased fluid impinges the web as its lattice structure and coherence develop. Effective first stage entanglement in the invention is effected by energy output to the composite web 16 of at least 0.06 hp-hr/lb and preferably in the range of 0.13–0.33 hp-hr/lb. As set forth more fully hereinafter, first stage entanglement employs limited energy levels and is designed to provide a "pre-entanglement" cohesive web for processing in the drum module of the invention.

TABLE I

| | Forming Screen Specifications | |
|---|---|---|
| Property | 36 × 29 flat | 16 × 14 flat |
| Warp wire - Polyester Round | .0157 | .032 |
| Shute wire - Polyester Round | .0157 | .035 |
| Weave type | plain mesh | plain mesh |
| Open area | 23.7% | 24.9% |
| Plane difference | — | .008" ± .003 |
| Snag | light | none ± light |
| Weave tightness (slay) | no angular displacement | no angular displacement |
| Edges | filled ½" each side | filled ½" each side |
| Seam | invisible/endless | invisible/endless |

Figure 4B:
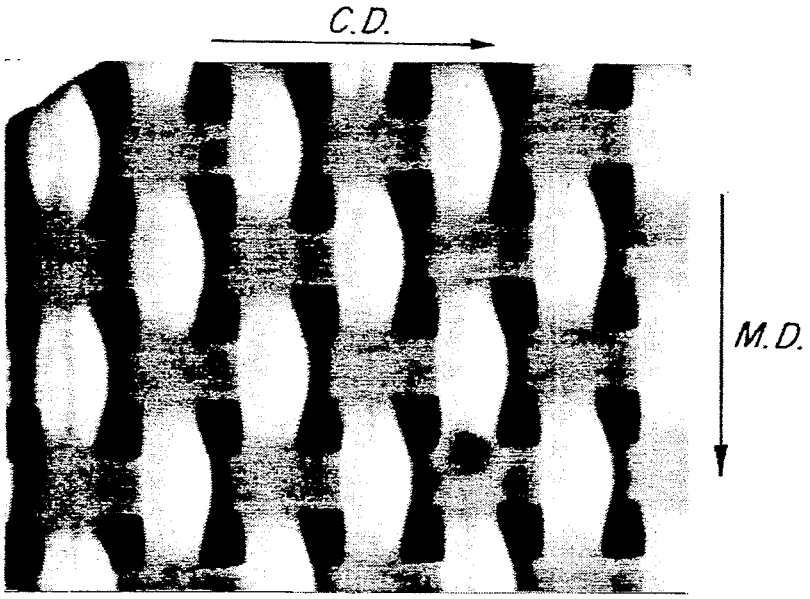
FIG. 4B is a photograph at 9× magnification of a 16×14 mesh plain weave forming member employed in the flat entangling module of Examples I–III.
Figure 4C:
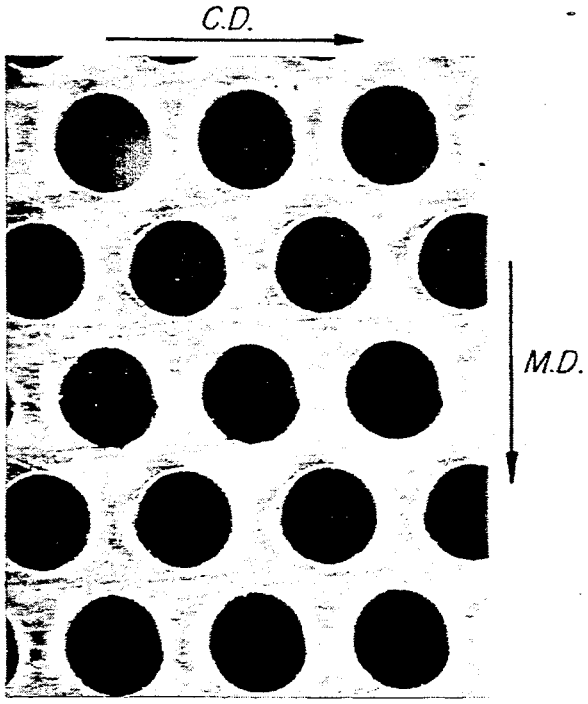
FIG. 4C is a photograph at 9× magnification of a web entangling screen which includes a plurality of symmetrical apertures each having squared circumferential edges.

Following the first stage entanglement, the composite web 16 is advanced to module 20 which entangles the bottom side 16*b* of the web. Module 20 includes a second entangling member, shown in FIG. 4B, designated 52, which has a cylindrical configuration and a symmetrical pattern of void areas 54. Manifolds 56 which carry jet nozzles are stacked in close proximity spaced from the entangling member 52 to impact the web with ramped essentially columnar jet sprays. The manifolds are preferably spaced 8 inches apart, ½ inch from the entangling member, and impact the web with a fluid "curtain" at pressures in the range of 300 to 2000 psi.

In accordance with the invention, control means are provided for focusing fluid energy associated with the fluid curtain into discrete concentrated patterns corresponding to the symmetrical void areas 54 of entangling member 52. The fluid curtain coacts with the entangling member and control means to precisely orient the fiber structure and entangle web fibers into a coherent lattice structure.

Figure 4D:
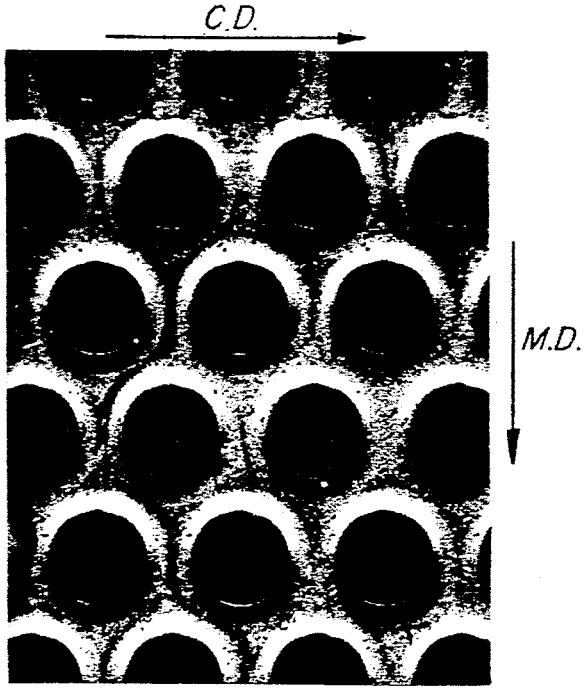
FIG. 4D is a photograph at 9× magnification, similar to FIG. 4A, of an entangling screen in accordance with the invention in which the apertures have inwardly radiused peripheral edges which define frusto-conical apertures.
Figure 5A:
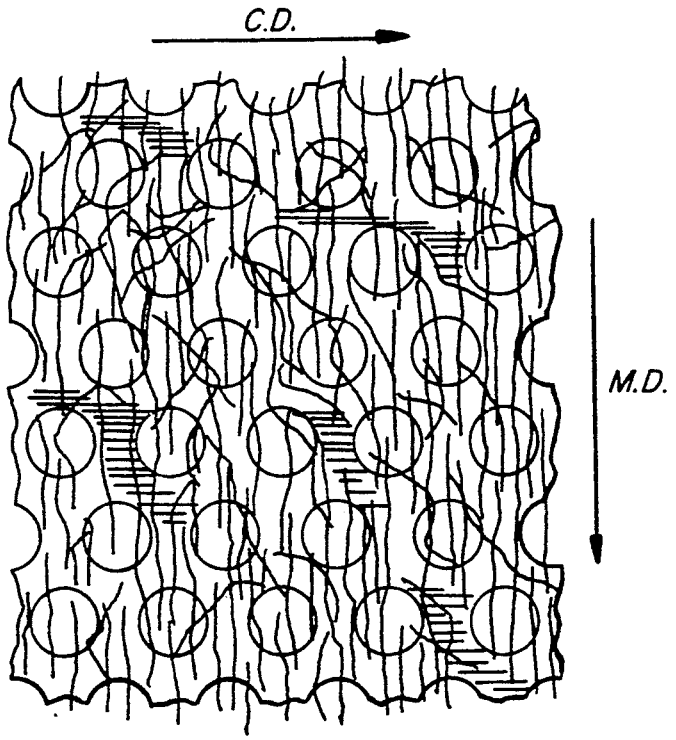
FIG. 5A is a plan view of an MD aligned carded web overlying the frusto-conical entangling member of FIG. 4B prior to entanglement processing.
Figure 5B:
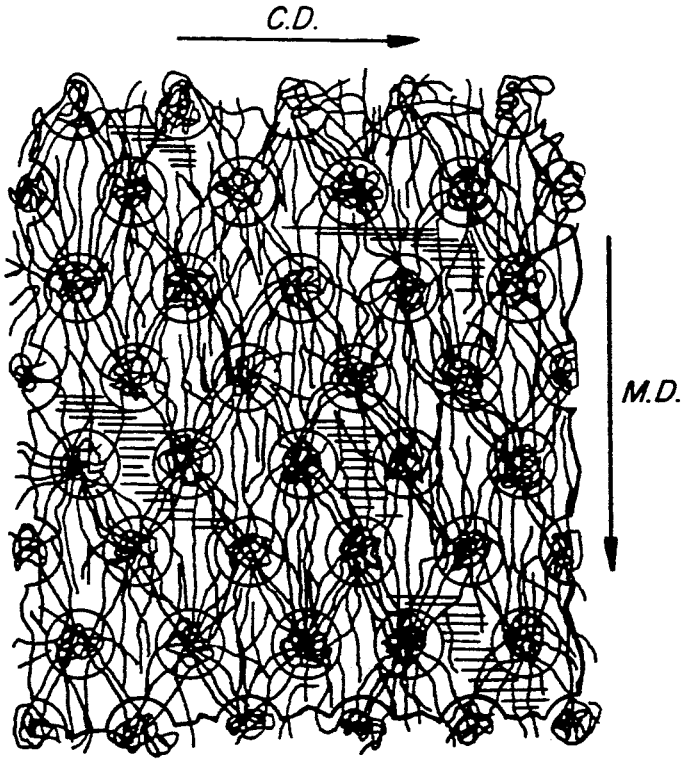
FIG. 5B is a plan view, similar to FIG. 5A, of the MD aligned web following entanglement processing in accordance with the invention.

FIGS. 4D and 5A and B illustrate a preferred embodiment of the entangling member 52 which is formed from a plate fabricated of stainless steel in which the void areas 54 comprise generally circular apertures defined by circumferential edges 58. In this embodiment, the control means comprises baffle members or flanges 60 which are integral with and depend downwardly from the circumferential aperture edges. Preferred entangling results are obtained by provision of baffle members 60 including a radiused curvature which define apertures having a "frusto-conical" configuration.

It is a feature of the invention to employ an entangling member 52 which has a symmetrical pattern of frusto-conical void areas or apertures 54 which correspond to preferred fabric patterns. The void areas occupy at least 15%, and preferably 35% or more, of the entangling member area. The preferred pattern includes a plurality of frusto-conical apertures 54 arranged so that the spacing ratio of machine direction ("MD") apertures is greater than cross direction ("CD") apertures. For example, the apertures 54 may have diameters of 1/16 inch and a center to center staggered aperture spacing of 3/32 inch. The MD and CD apertures respectively have center to center spacings of 0.16 and 0.092 inch. A preferred screen, schematically illustrated in FIG. 6B, has a thickness D-1 of 0.030 inch, and aperture opening dimensions at the top and bottom sides of the screen, D-2 and D-3, respectively of 0.093 and 0.062 inch.

FIGS. 5A and B are schematic illustrations of the frusto-conical member of the invention supporting a web before and after hydroentangling in accordance with the invention. It can be seen that web fibers migrate to void areas 54 in the entangling member to form a novel textile-like fabric pattern in which an array of dense nodes are connected by a generally uniform cover of interstitial fibers.

Use of the control means of the invention in conjunction with the patterning member obtains enhanced energy and processing efficiencies in the production of nonwoven fabrics. Dynamic fluid energy is directed to the web with improved efficiency through use of baffle structures which focus the impacting fluids on the web. Improved energy transfer to the web enhances entanglement of web fibers and imparts a textile-like fabric finish to the entangled web.

Effective second stage entanglement is effected by energy output to the web 16 of at least 0.13 hp-hr/lb and preferably in the range of 0.26–0.6 hp-hr/lb. A preferred energy distribution for first and second stage entanglement modules is ⅓ and ⅔ respectively. The first stage entanglement energy level is selected for purposes of providing a stable web for second stage entanglement where the control means of the invention is employed to impart a cohesive textured finish to the web.

Figure 6A:
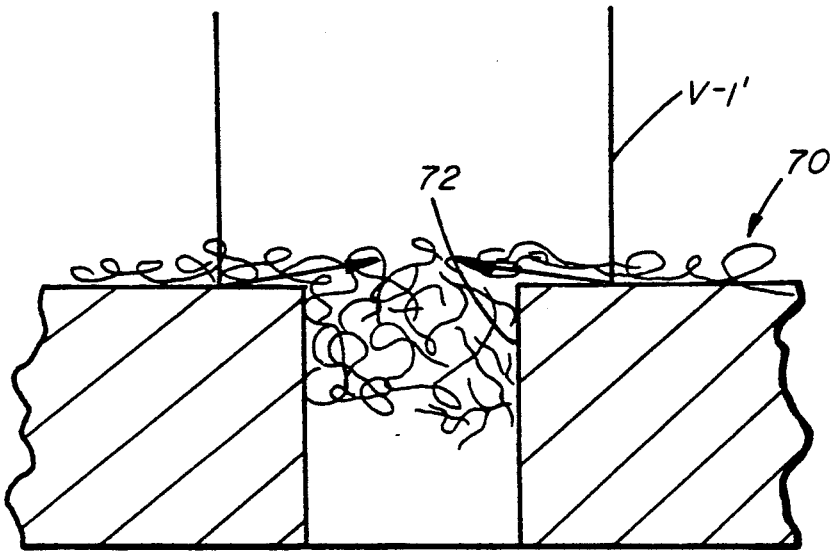
FIGS. 6A and B are cross-sectional schematic views of squared and radiused aperture screens, supporting web materials thereon, illustrating fluid dynamic vector forces which impact the web during hydroentangling processing.
Figure 6B:
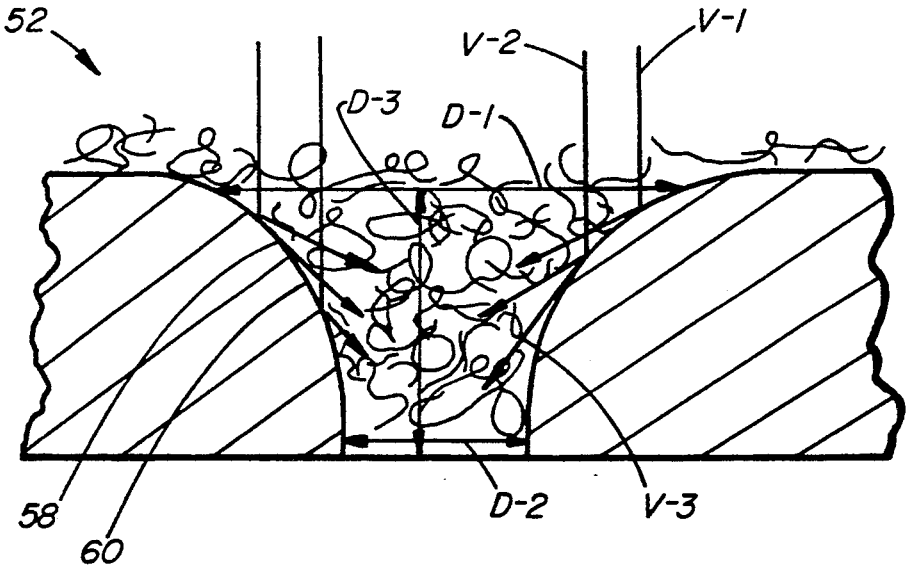

FIGS. 6A and B respectively illustrate dynamic fluid forces which operate in conventional apertured entangling member 70 which includes squared edges 72 and the frusto-conical member 52 of the invention. Fluid vector forces in the square and frusto-conical members 52, 72 are respectively designated, V-1, V-2, V-3 and V-1'. Vector forces in the frusto-conical member 52 are uniformly directed into void areas 54 of the member upon impact with radiused surfaces of baffle members 60. Downward and inward direction of the fluid vectors obtains efficient energy transfer to the web of fluid forces. It will be seen that in the conventional squared edge member 70, fluid forces are, in part, directed across the web surface with consequent dissipation of fluid energy.

Following entanglement the web 16 is passed through the vacuum slot extractor 22 to remove excess water and prepare the web for application of a binder in the padder station 24, and then cured in dry cans 26 in a conventional manner. See FIG. 1.

Nonwoven fabrics produced by the dual entangling process of the invention are characterized by close knit fiber interstitial binding which enhances the fabric tensile strength and aesthetics. Preferred fabrics of the invention are fabricated of rayon, polyester, and cotton fibers, and combinations thereof, provided in webs having a basis weight in the range of 20 to 120 gsy. For example, composite web blends of polyester/rayon and polyester/cotton can be used. Fabrics in accordance with the invention are uniform in fiber distribution and have MD/CD ratios in the range of 1/1 to 4/1.

Figure 7:
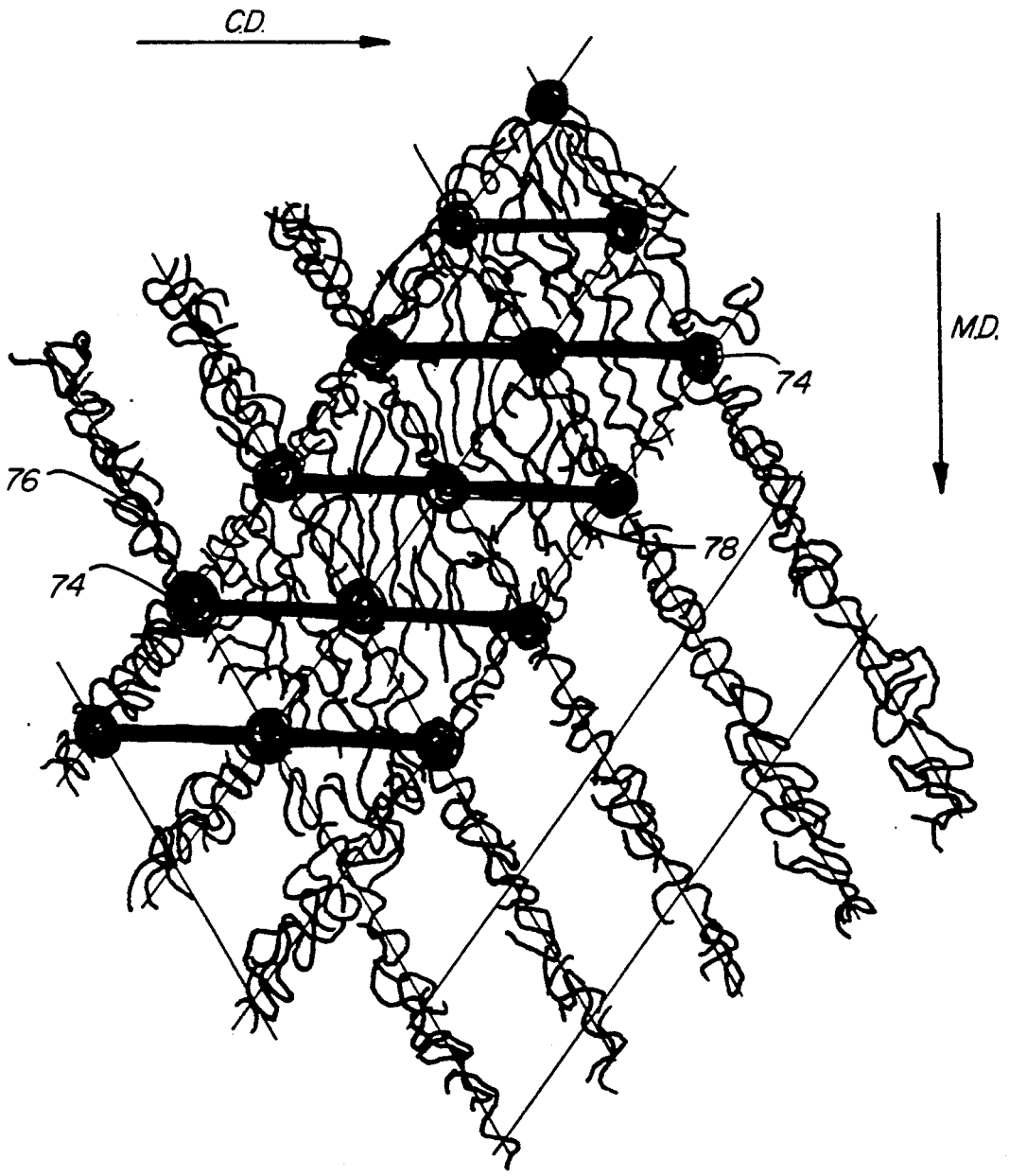
FIG. 7 is a schematic illustration of a nonwoven fabric produced on the production line employing the forming members of FIG. 4B.

FIG. 7 schematically illustrates a preferred fabric structure of the invention which is obtained employing the entangling members 44, 52 of FIGS. 4A and D. Fluid entangled fibers are arranged in a symmetrical array including a lattice structure of dense fiber nodes 74 corresponding to the aperture pattern of the frusto-conical member, and spaced generally parallel and criss-crossing MD bands 76 which intersect the nodes 74. The nodes 74 are also connected by CD oriented spaced and parallel fiber bands 78 which enhance CD tensile strength of the fabric. A textile-like aesthetic finish in the fabric is provided by interstitial fibers which substantially occupy interstitial areas defined by the fibrous bands.

Figure 2:
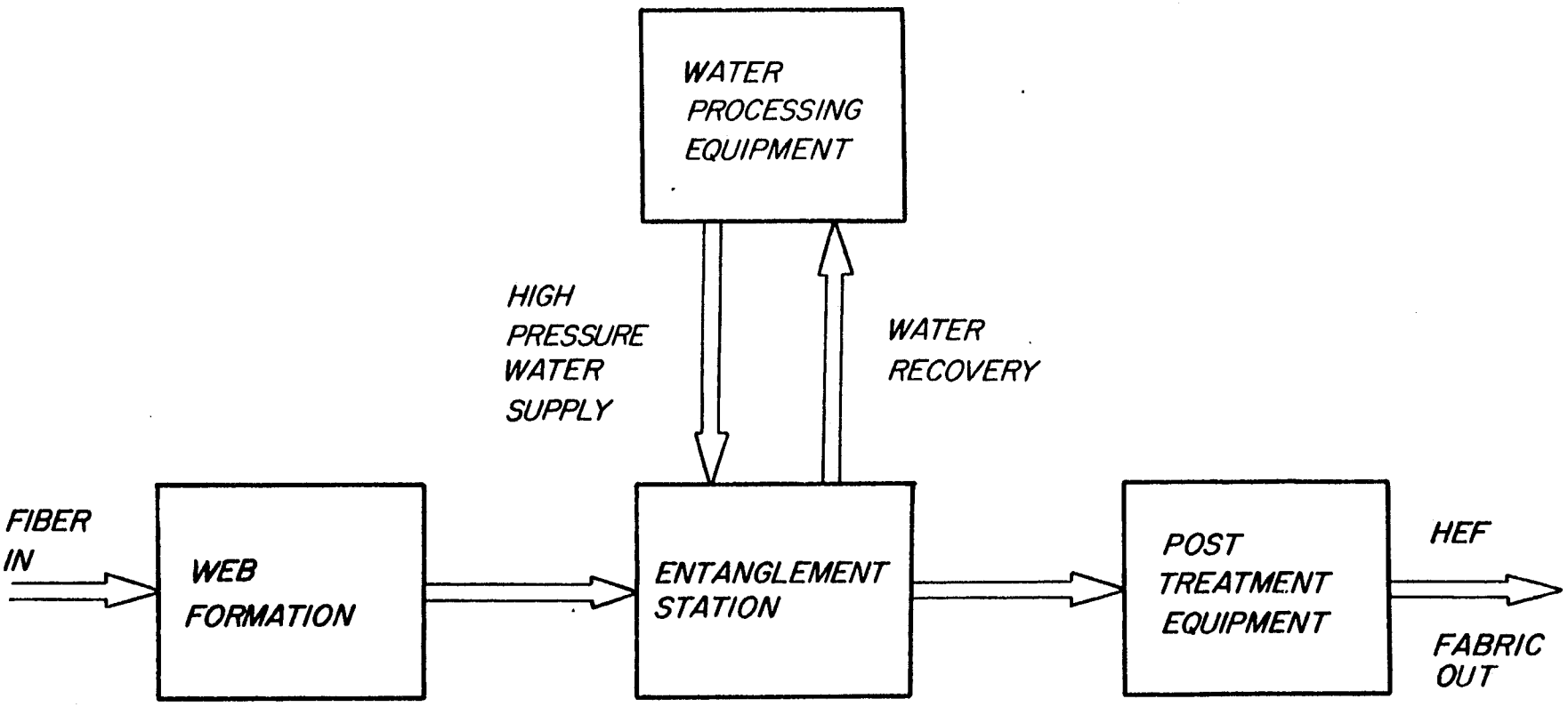
FIG. 2 is a schematic illustration of a hydroentangling process of the invention.
Figure 8A:
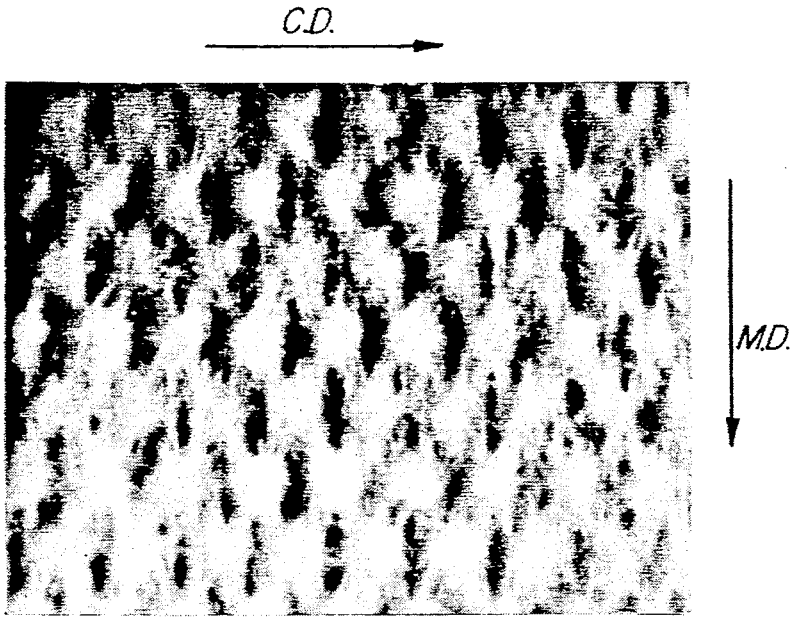
FIGS. 8A and B are photographs at 4.5× magnification of nonwoven fabrics disclosed in Example I, respectively produced on the square and radiused entangling members of FIGS. 4C and D.
Figure 8B:
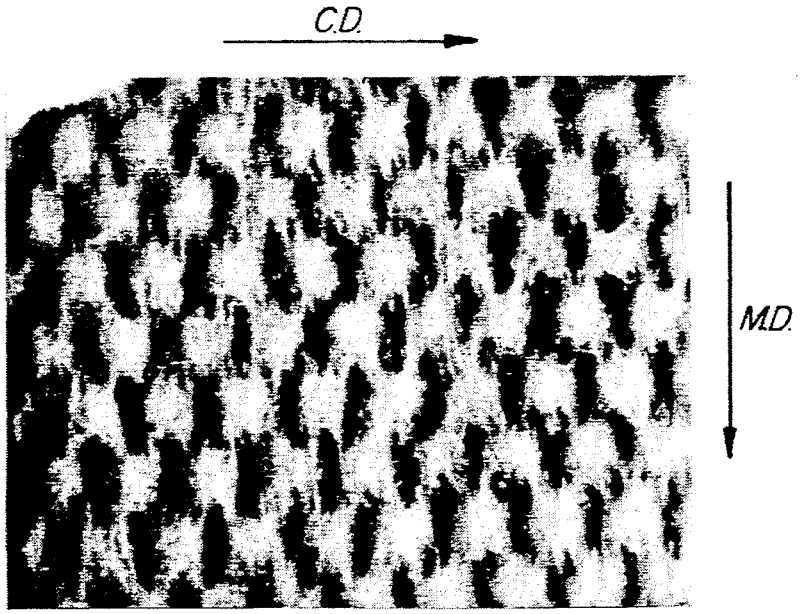
Figure 9A:
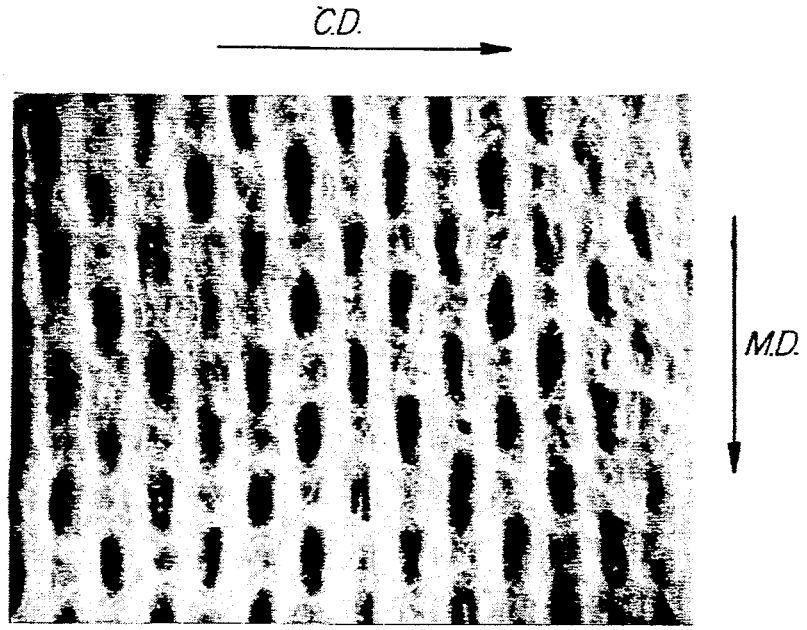
FIGS. 9A and B are photographs at 4.5× magnification of nonwoven fabrics disclosed in Example II, respectively produced on the 16×24 woven and radiused entangling members of FIGS. 4B and D.
Figure 9B:
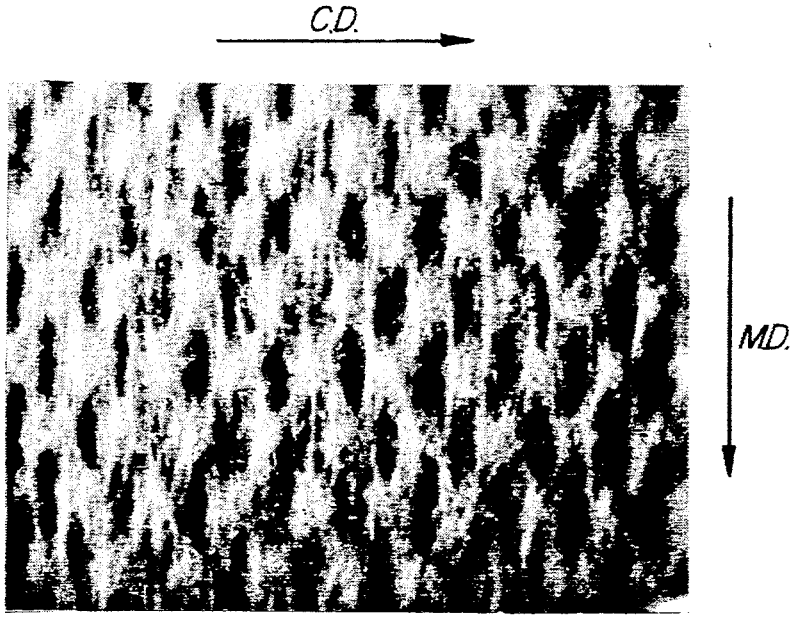
Figure 10A:
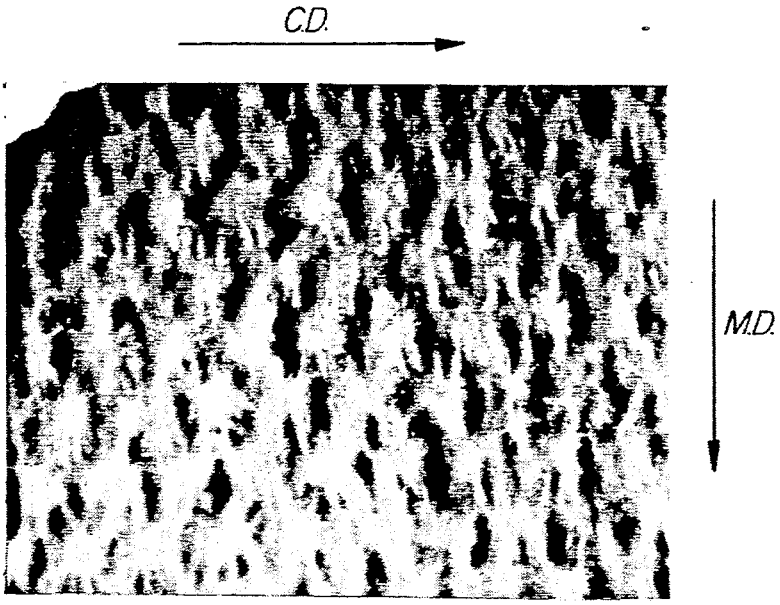
FIGS. 10A and B are photographs at 4.5× magnification of nonwoven fabrics disclosed in Example I, respectively produced on the square and radiused entangling members of FIGS. 4C and D.
Figure 10B:
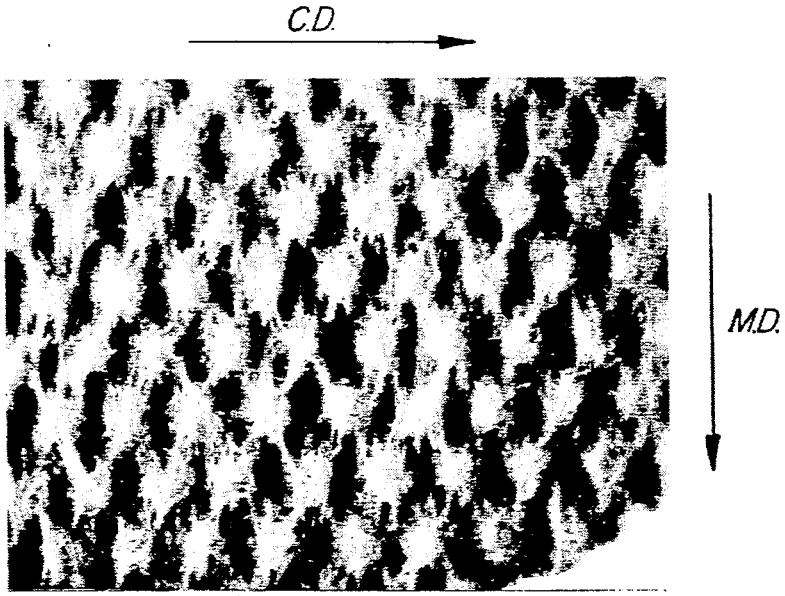

Examples 1–3 and corresponding FIGS. 8–10 describe and illustrate representative fabrics produced by the method of the invention employing the entangling members 44, 52, and production line 10, 10' of FIGS. 1, 1A. Attention is directed to FIG. 2 which shows a process flow diagram of the invention.

For these applications stainless steel manifolds were spaced apart distances of 8 or more inches and ½ inch above the web. Each manifold was equipped with a strip of columnar jet orifices having 0.005 inch diameters at spacing densities of 60 orifices/inch. Examples 1–2 and 3, respectively, employ a total of 5 and 6 manifolds. As set forth in the Examples, manifold pressures were ramped from low to high pressure levels to effect a cohesive and uniform hydroentanglement.

Planar and drum entangling modules of the FIG. 1 and 1A lines were respectively equipped with 16×14 mesh woven and 1/16 diameter on 3/32 inch centered apertured screens. Specifications for the woven entangling member are set forth in Table I. Dry cans at pressure settings of 100 psi were employed to provide finished fabrics for analysis.

Energy imparted to the web by each manifold in the entanglement modules is calculated by summing the energy output for each manifold in accordance with the following equation:

$$E = \frac{14.2\ C\ D^2\ p^{1.5}\ N}{S\ W}$$

where,

E=Hp-hr/lb fiber
C=Jet discharge coefficient (dimensionless)
D=Orifice diameter (inches)
P=Manifold pressure
N=Jet density (jets/inch)
S=Line speed (feet/minute)
W=Web basis weight (grams/square yard)

The discharge coefficient (C) is dependent on jet pressure and orifice size. Coefficients for a jet having an orifice diameter of 0.005 inch and ambient water temperature are as follows:

| Pressure (psi) | C |
|---|---|
| 300 | .77 |
| 400 | .74 |
| 500 | .71 |
| 600 | .70 |
| 700 | .68 |
| 800 | .67 |
| 900 | .66 |
| 1000 | .65 |
| 1100 | .64 |
| 1200 | .63 |
| 1300 | .62 |
| 1800 | .62 |
| 1900 | .62 |

Fabric samples in the Examples were produced at energy levels of 0.2, 0.4 and 1.0 hp-hr/lb. In each Example a fibrous web was entangled on one side in the planar module and then on its other side in the drum module. Approximate energy input to the web in the planar and drum modules, respectively, was ⅓ and ⅔ of total entangling energy. Computations of the energy distribution in each manifold and totals for the modules are described in the Examples and set forth in Tables II, III and IV.

Fabrics produced in Examples I–II are illustrated in FIGS. 8–10.

EXAMPLE I

Heavyweight hydroentangled polyester fabrics were produced from a scrambled web of 1.5 denier and 1.5 inch staple length type T180 polyester produced by Hoechst Celanese Corporation, Charlotte, N.C.

The hydroentangling process line of FIGS. 1 and 3 was employed in three separate runs at process speeds of 70, 65 and 40 feet per minute, and respective energy levels of 0.2, 0.4 and 1 hp-hr/lb. Web materials from carding apparatus were advanced through the random web former 12 for processing in planar and drum modules 18, 20. Manifold pressures were ramped for the 0.2, 0.4 and 1 hp-hr/lb runs, respectively, between pressures of 400–700, 600–1200 and 500–1500. See Tables II–IV. The entangled web was advanced through extractor and padder stations 22, 24 (without application of a binder) to dry cans 26 which were set at a steam pressure of 100 psi to provide a coherent fabric.

Figure 11A:
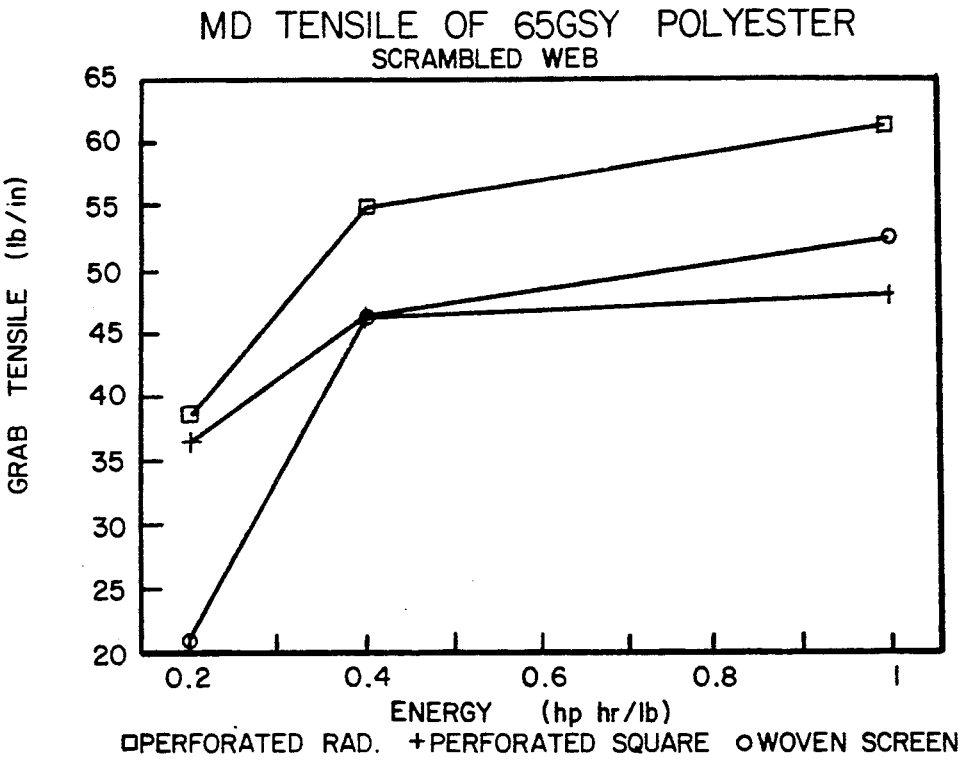
FIGS. 11A and B are graphs which set forth MD and CD tensile characteristics of the nonwoven fabrics of Example I.
Figure 11B:
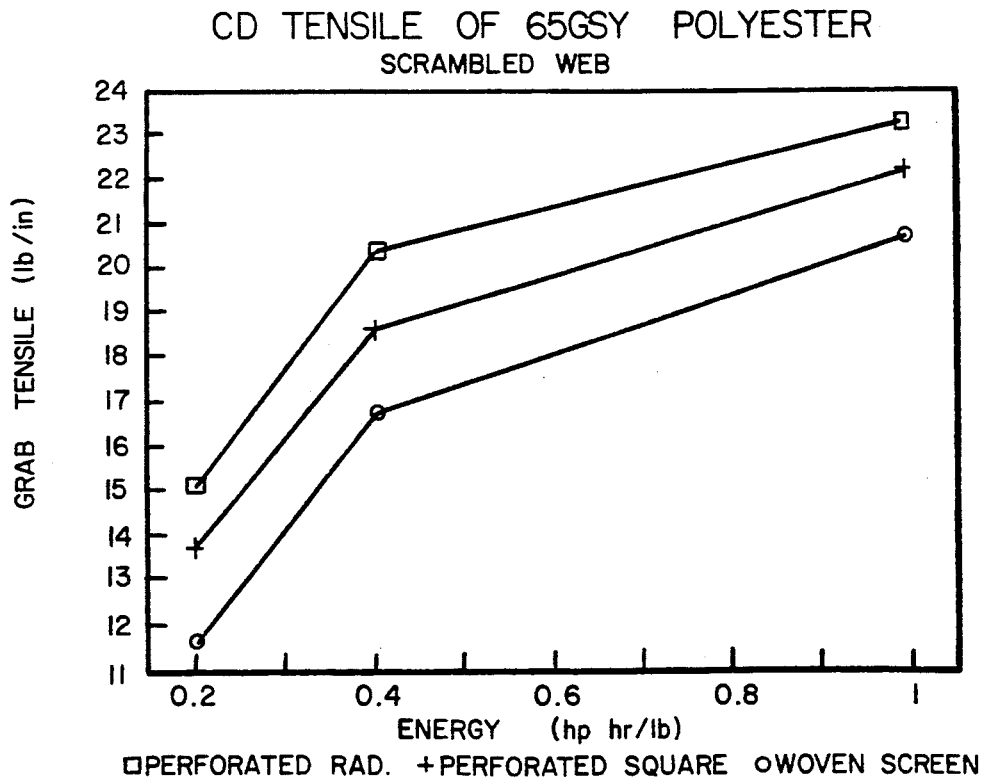

For comparative analysis, fabric samples of this Example were run on a modified FIG. 1 process line in which a conventional squared edge and 16×14 (28% open area) woven entangling members, respectively, were employed instead of the frusto-conical member of the invention. Table V and FIGS. 11A and B set forth physical characteristics and tensile characteristics of the Example I fabrics.

FIGS. 8A and B are photomicrographs at magnifications of 4.5× of fabric produced at 1.0 hp-hr/lb fabric on the square and frusto-conical entangling members. At a normalized weight of 65 gsy this fabric has an MD/CD ratio of 2.6/1, and grab tensile strength in machine and cross directions of 61/23 lbs/in. This result is contrasted with corresponding MD/CD ratio and tensile strengths in the square and woven screen control runs of:

| MD/CD: | Ratio | Tensile Strengths |
|---|---|---|
| Square: | 2.2/1 | 47.9/22.1 |
| Woven: | 2.5/1 | 52/20 |

Advantage in the invention is obtained with percentage increase in MD/CD tensile strengths (1.0 hp-hr/lb fabric) in the frusto-conical run over the square run of 17 and 15%, respectively.

EXAMPLES II-III

Example II fabrics were produced employing the apparatus of FIG. 1 modified in that the random web former 12 was disabled, and a peeler roller (not shown) was positioned in-line between card C6 and the entanglement modules. This line arrangement provided a substantially MD aligned web for processing in the entanglement modules. Specifications for the entangling members 44, 52 and web are in other respects identical to those of Example I.

FIGS. 9A and B are photomicrographs at magnifications of 4.5× of fabric produced at 1.0 hp-hr/lb on the woven and frusto-conical entangling members.

Figure 12A:
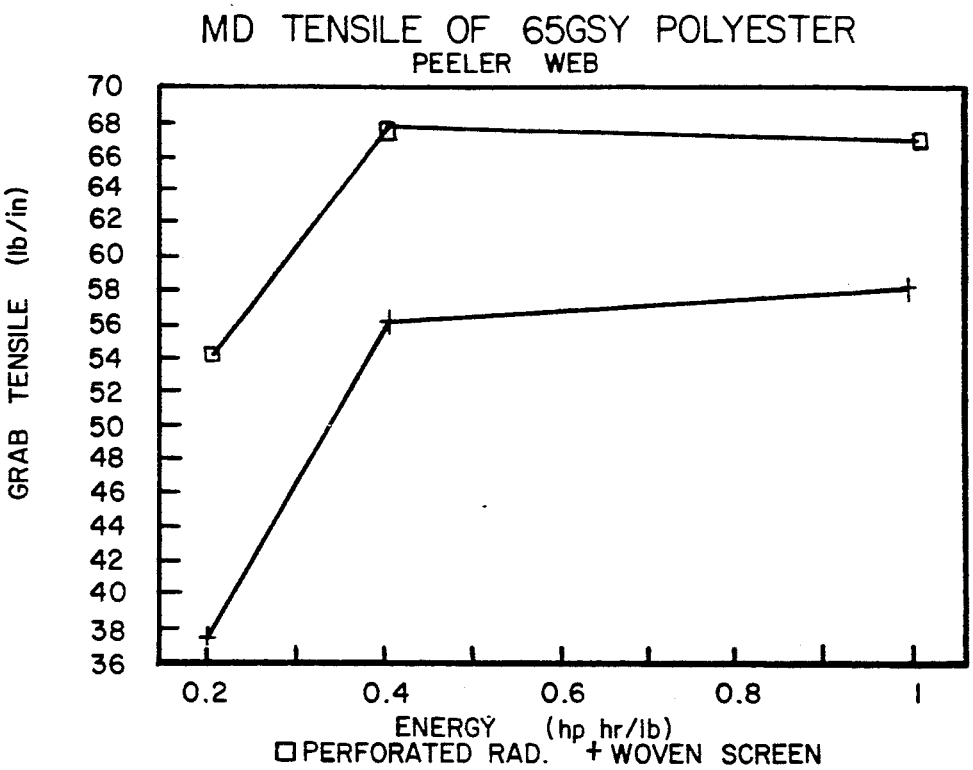
FIGS. 12A and B are graphs which set forth MD and CD tensile characteristics of the nonwoven fabrics of Example II.
Figure 12B:
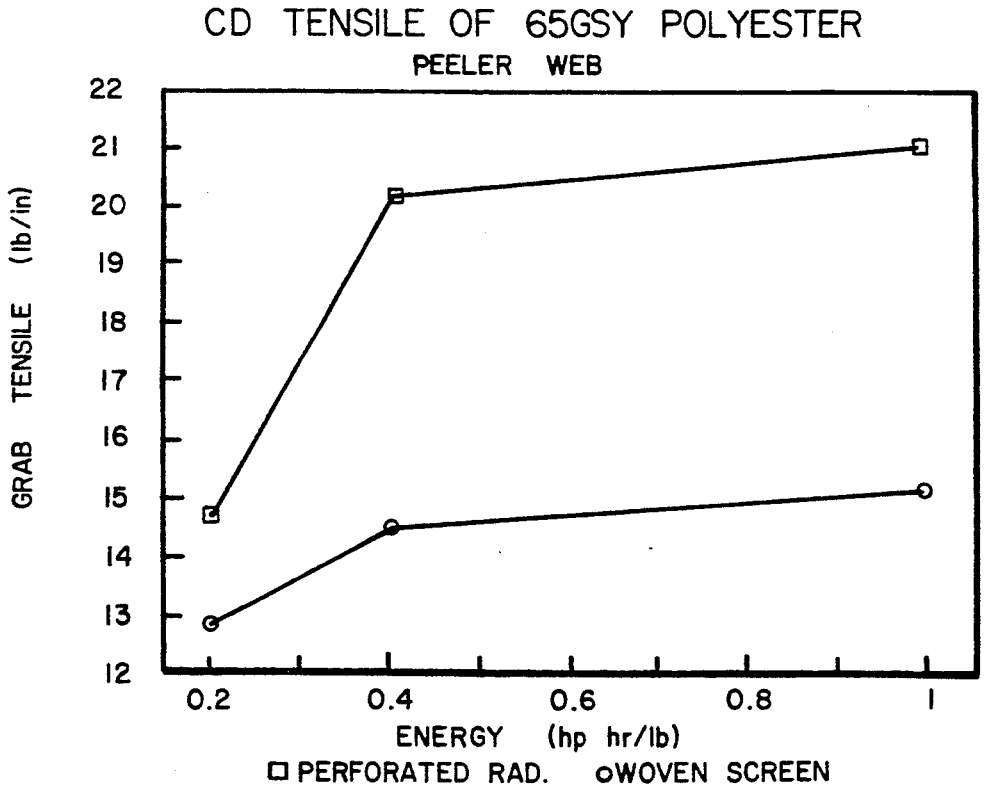

Table VI and FIGS. 12A and B set forth physical characteristics and tensile properties of the Example II fabrics. Data concerning control samples employing the woven screen (16×24) are set forth for comparative purposes. At an energy level of 1.0 hp-hr/lb, the fabric processed on the frusto-conical member exhibited an increase in MD/CD tensile strength over the woven run of 15 and 40%, respectively.

Example III fabrics were produced employing the apparatus line illustrated in FIG. 1A. As described above, this line differs from FIG. 1 in the provision of 50/50 air laid/carded composite web 16' for hydroentangling processing.

FIGS. 10A and B are photomicrographs at magnifications of 4.5× of a fabric produced at 1.0 hp-hr/lb on the square and frusto-conical entangling members.

Figure 13A:
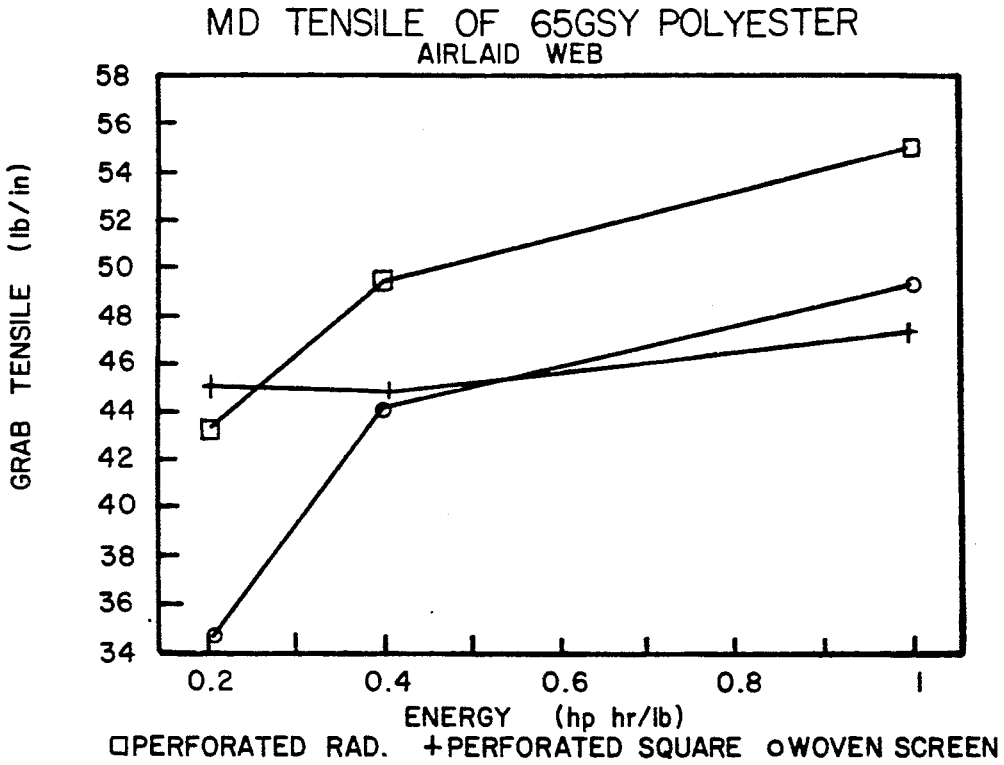
FIGS. 13A and B are graphs which set forth MD and CD tensile characteristics of the nonwoven fabrics of Example III.
Figure 13B:
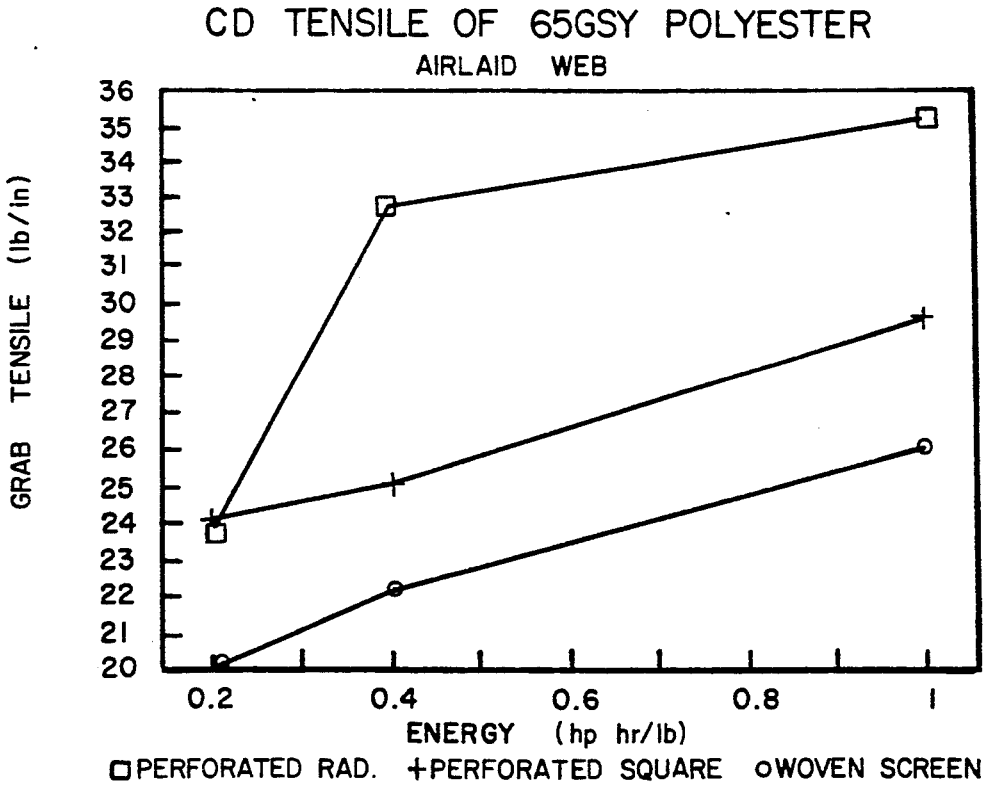

Table VII and FIGS. 13A and B set forth physical characteristics and tensile properties of the Example III fabrics. Samples employing squared edge perforated and a 16×24 woven screen are set forth for comparative purposes. At an energy level of 1.0 hp-hr/lb, the fabric processed on the frusto-conical member exhibited an increase in MD/CD tensile strength over the square run of 12 and 35%, respectively.

Analysis of Tables V–VII and associated FIGS. 11A, 11B, 12A, 12B, 13A and 13B demonstrates that marked enhancement in fabric characteristics was obtained employing the control means and process of the invention.

TABLE II

Hydroentangling Energy at 70 FPM
Energy - 0.20 hp-hr/lb

| Manifold No. | Pressure psi | Flow gal/min | Energy hp-hr/lb | Total hp-hr/lb | Energy distribution % |
|---|---|---|---|---|---|
| | | Flatscreen - Module 18 | | | |
| 1 | 400 | 17 | 0.03 | 0.03 | |
| 2 | 500 | 18 | 0.04 | 0.06 | |
| | | Screen Total | | 0.06 | 31% |
| | | Drum Screen - Module 20 | | | |
| 3 | 500 | 18 | 0.04 | 0.04 | |
| 4 | 600 | 20 | 0.05 | 0.09 | |
| 5 | 700 | 21 | 0.06 | 0.14 | |
| | | Screen Total | | 0.14 | 69% |
| | | TOTAL ENERGY | | 0.21 hp-hr/lb | |

TABLE III

Hydroentangling Energy at 65 FPM
Energy - 0.40 hp-hr/lb

| Manifold No. | Pressure psi | Flow gal/min | Energy hp-hr/lb | Total hp-hr/lb | Energy distribution % |
|---|---|---|---|---|---|
| | | Flatscreen - Module 18 | | | |
| 1 | 600 | 20 | 0.05 | 0.05 | |
| 2 | 800 | 22 | 0.08 | 0.13 | |
| | | Screen Total | | 0.13 | 31% |
| | | Drum Screen - Module 20 | | | |
| 3 | 700 | 21 | 0.06 | 0.06 | |
| 4 | 900 | 23 | 0.09 | 0.15 | |
| 5 | 1200 | 25 | 0.13 | 0.29 | |
| | | Screen Total | | 0.29 | 69% |
| | | TOTAL ENERGY | | 0.41 hp-hr/lb | |

TABLE IV

Hydroentangling Energy at 40 FPM
Energy - 1.0 hp-hr/lb

| Manifold No. | Pressure psi | Flow gal/min | Energy hp-hr/lb | Total hp-hr/lb | Energy distribution % |
|---|---|---|---|---|---|
| | | Flatscreen - Module 18 | | | |
| 1 | 500 | 18 | 0.07 | 0.07 | |
| 2 | 800 | 22 | 0.12 | 0.19 | |
| 3 | 900 | 23 | 0.15 | 0.34 | |
| | | Screen Total | | 0.34 | 33% |
| | | Drum Screen - Module 20 | | | |
| 4 | 900 | 23 | 0.15 | 0.15 | |
| 5 | 1300 | 26 | 0.24 | 0.38 | |
| 6 | 1500 | 28 | 0.30 | 0.68 | |
| | | Screen Total | | 0.68 | 67% |
| | | TOTAL ENERGY | | 1.01 hp-hr/lb | |

TABLE V

Example I - Fabric Properties
65GSY POLYESTER HEF (SCRAMBLED WEB)

| SCREEN TYPE | ENTRY GEOMETRY | DESCRIPTION | OPEN AREA | ENERGY (g/yd$^2$) | WEIGHT (lbs/in) |
|---|---|---|---|---|---|
| PERFORATED | RADIUS | 1/16" DIA holes on 3/32" CRS | 41% | 1.0 | 64 |
| | | | | 0.4 | 60 |
| | | | | 0.2 | 58 |

TABLE V-continued

Example I - Fabric Properties
65GSY POLYESTER HEF (SCRAMBLED WEB)

| | | | | | |
|---|---|---|---|---|---|
| PERFORATED | SQUARE | 1/16" DIA holes on 3/32" CRS | 41% | 1.0 | 65 |
| | | | | 0.4 | 61 |
| | | | | 0.2 | 58 |
| WOVEN | | Plain Weave 16 × 14 | 28% | 1.0 | 62 |
| | | | | 0.4 | 59 |
| | | | | 0.2 | 58 |

| | MACHINE DIRECTION | | | CROSS DIRECTION | | |
|---|---|---|---|---|---|---|
| SCREEN TYPE | STRENGTH NOR 65 g | STRENGTH % | ELONG. (lbs/in) | STRENGTH NOR 65 g | STRENGTH (%) | ELONG. |
| PERFORATED | 60 | 61.0 | 37 | 23 | 23.1 | 121 |
| | 51 | 55.1 | 38 | 19 | 20.4 | 135 |
| | 34 | 38.4 | 51 | 13 | 15.1 | 160 |
| PERFORATED | 48 | 47.9 | 34 | 22 | 22.1 | 120 |
| | 44 | 46.4 | 37 | 18 | 18.6 | 133 |
| | 32 | 36.4 | 51 | 12 | 13.8 | 166 |
| WOVEN | 50 | 52.2 | 40 | 20 | 20.6 | 137 |
| | 42 | 46.4 | 45 | 15 | 16.7 | 157 |
| | 19 | 21.0 | 65 | 10 | 11.5 | 185 |

TABLE VI

Example II - Fabric Properties
65GSY POLYESTER HEF (PEELER ROLL)

| SCREEN TYPE | ENTRY GEOMETRY | DESCRIPTION | OPEN AREA | ENERGY (HP) | WEIGHT (g/yd$^2$) |
|---|---|---|---|---|---|
| PERFORATED | RADIUS | 1/16" DIA holes on 3/32" CRS | 41% | 1.0 | 69 |
| | | | | 0.4 | 70 |
| | | | | 0.2 | 67 |
| WOVEN | | PLAIN WEAVE 14 × 16 | 28% | 1.0 | 68 |
| | | | | 0.4 | 70 |
| | | | | 0.2 | 66 |

| | MACHINE DIRECTION | | | CROSS DIRECTION | | |
|---|---|---|---|---|---|---|
| SCREEN TYPE | STRENGTH (lbs/in) | STRENGTH NOR 65 g | ELONG. (%) | STRENGTH (lbs/in) | STRENGTH NOR 65 g | ELONG. (%) |
| PERFORATED | 72 | 67.3 | 32 | 22 | 21.0 | 160 |
| | 73 | 68.0 | 31 | 22 | 20.2 | 154 |
| | 55 | 54.1 | 43 | 15 | 14.7 | 168 |
| WOVEN | 61 | 58.4 | 33 | 16 | 15.0 | 176 |
| | 61 | 56.4 | 33 | 16 | 14.5 | 177 |
| | 38 | 37.4 | 52 | 13 | 12.8 | 193 |

TABLE VII

Example III - Fabric Properties
65GSY POLYESTER HEF (AIR LAID WEB)

| SCREEN TYPE | ENTRY GEOMETRY | DESCRIPTION | OPEN AREA | ENERGY (HP) | WEIGHT (g/yd$^2$) |
|---|---|---|---|---|---|
| PERFORATED | RADIUS | 1/16" DIA holes on 3/32" CRS | 41% | 1.0 | 66 |
| | | | | 0.4 | 56 |
| | | | | 0.2 | 51 |
| PERFORATED | SQUARE | 1/16" DIA holes on 3/32" CRS | 41% | 1.0 | 64 |
| | | | | 0.4 | 61 |
| | | | | 0.2 | 50 |
| WOVEN | | Plain Weave 16 × 14 | 28% | 1.0 | 68 |
| | | | | 0.4 | 59 |
| | | | | 0.2 | 49 |

| | MACHINE DIRECTION | | | CROSS DIRECTION | | |
|---|---|---|---|---|---|---|
| SCREEN TYPE | STRENGTH (lbs/in) | STRENGTH NOR 65 g | ELONG. (%) | STRENGTH (lbs/in) | STRENGTH NOR 65 g | ELONG. (%) |
| PERFORATED | 56 | 55.0 | 37 | 36 | 34.8 | 96 |
| | 43 | 49.5 | 43 | 28 | 32.7 | 105 |
| | 34 | 43.2 | 54 | 19 | 23.8 | 118 |
| PERFORATED | 47 | 47.3 | 39 | 29 | 29.2 | 100 |
| | 42 | 44.9 | 47 | 23 | 25.0 | 101 |
| | 35 | 45.1 | 60 | 19 | 24.1 | 119 |
| WOVEN | 51 | 49.2 | 46 | 27 | 25.7 | 112 |
| | 40 | 44.3 | 51 | 20 | 22.1 | 120 |
| | 26 | 34.2 | 62 | 15 | 20.0 | 129 |

From the foregoing, it will be appreciated that the invention achieves the objects stated heretofore. An apparatus 10 of uncomplex design is provided which obtains enhanced energy efficiencies in hydroentangling processing of nonwoven materials. Advantage is obtained in the invention by provision of novel frusto-conical entangling member 52 which directs fluid forces into a discrete and focused pattern to effect web entanglement. Advantageously, the frusto-conical entangling member may be employed on conventional process lines without requirement of extensive retooling.

Surprisingly, it was determined nonwoven fabrics having textile-like aesthetics may be obtained by processing heavyweight webs at relatively low energy levels on conventional hydroentangling lines using apertured forming members, in particular, webs in the weight range of 40–120 gsy at energies of approximately 0.4 hp-hr/lb. Two stage entanglement in accordance with the invention employing a frusto-conical or radiused entry entangling member obtains further advantage in fabric aesthetics and tensile strength characteristics.

It will be recognized by those skilled in the art that the apparatus and process of the invention have wide application in the production of a diversity of patterned nonwoven fabrics with characteristics determined by the design and specifications of the entangling member.

Numerous modifications are possible in light of the above disclosure. For example, although the preferred entangling member has a frusto-conical configuration, other geometric configurations which include separate or integral baffling structures may be employed in the invention apparatus. Similarly, although the preferred process line of the invention employs a "pre-entanglement" module, it will be recognized that this process step may be dispensed with and/or supplemented with other web formation process steps.

Finally, the invention encompasses post-entanglement web processing. For example, it has been determined that conventional tentering applications have application in the invention to enhance CD fabric strength characteristics. On the process line of FIG. 1, advantage can be obtained by situating a tentering station in-line between the entangling modules and dry cans.

Therefore, it is to be understood that although preferred embodiments of the invention have been described, numerous modifications and variations are of course possible within the principles of the invention. All such embodiments, modifications and variations are considered to be within the spirit and scope of the invention as defined in the claims appended hereto.

We claim:

1. A method for producing a textured nonwoven fabric which comprises the steps of:

(a) supporting a composite web of staple fibers on an entangling member including a symmetrical pattern of void areas which are fluid pervious;

(b) directing a continuous curtain of columnar fluid downwardly through the nonwoven web and onto said entangling member;

(c) redirecting portions of the curtain of fluid by angles less than 90 degrees to concentrate the energy flux of the redirected fluid inside said symmetrical void areas; and (d) traversing the web with the curtain until the fibers are randomized and entangled to produce a nonwoven fabric having a textured structure determined by said entangling member.

2. The method of claim 1, wherein said void areas occupy approximately 15% of the area of said entangling member, and said curtain impacts the web with energy of at least 0.2 hp-hr/lb.

3. The method of claim 2, wherein said void areas comprise a plurality of generally circular apertures each having a frusto-conical configuration.

4. The method of claim 3, wherein the apertures are arranged in a pattern in which the spacing of machine direction apertures is greater than the spacing of cross-direction apertures.

5. The method of claim 4, wherein the web is randomized prior to the entanglement processing.

6. The method of claim 3, comprising the further steps of supporting one side of the web with a pre-entanglement woven screen for first stage entanglement processing, and traversing one side of the web with the fluid curtain.

7. The method of claim 6, wherein said entangling member supports another side of the web for second stage entanglement processing.

8. The method of claim 7, wherein said fluid curtain impacts the web in said first and second stage entanglement processing with energies of at least 0.06 and 0.13 hp-hr/lb, respectively.

9. The method of claim 8, wherein said pre-entangling member is a woven screen.

10. The method of claim 1, wherein said void areas comprise apertures which have a circular cross section and a rim at the end thereof closest to said web which has a continuously curved radial section.

* * * * *